US008622620B2

(12) United States Patent
Beers et al.

(10) Patent No.: US 8,622,620 B2
(45) **Date of Patent: *Jan. 7, 2014**

(54) SHAFT FOR AIR BEARING AND MOTOR COOLING IN COMPRESSOR

(75) Inventors: Craig M. Beers, Wethersfield, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 563 days.

This patent is subject to a terminal disclaimer.

(21) Appl. No.: 12/882,264

(22) Filed: Sep. 15, 2010

(65) Prior Publication Data

US 2012/0064814 A1 Mar. 15, 2012

(51) Int. Cl.
*F16C 32/06* (2006.01)

(52) U.S. Cl.
USPC ..... 384/115; 464/179

(58) Field of Classification Search
None
See application file for complete search history.

(56) References Cited

U.S. PATENT DOCUMENTS 3,560,030 A * 2/1971 Mack et al. ..... 403/371
3,685,923 A * 8/1972 Hutchins et al. ..... 417/273
3,718,379 A * 2/1973 Williams et al. ..... 384/113
4,573,808 A * 3/1986 Katayama ..... 384/114
4,787,345 A * 11/1988 Thoma ..... 123/90.17
4,870,894 A * 10/1989 Toyoda et al. ..... 92/71
4,896,975 A * 1/1990 Bescoby et al. ..... 384/114
5,019,738 A * 5/1991 Weilbach et al. ..... 310/90.5
5,181,783 A * 1/1993 Sherman et al. ..... 384/114
5,211,531 A * 5/1993 Kakimoto ..... 415/112
5,267,839 A * 12/1993 Kimura et al. ..... 417/269
5,271,677 A * 12/1993 Sherman et al. ..... 384/114
5,293,794 A * 3/1994 Mosey ..... 82/125
5,423,183 A * 6/1995 Folsom ..... 60/492
5,562,182 A * 10/1996 Kayukawa et al. ..... 184/6.17
5,575,152 A * 11/1996 Folsom ..... 60/492
5,713,670 A * 2/1998 Goldowsky ..... 384/115
6,212,935 B1 * 4/2001 Shiozaki et al. ..... 73/9
6,249,366 B1 * 6/2001 Hinton et al. ..... 359/200.1
6,293,704 B1 * 9/2001 Gradu ..... 384/557
6,328,475 B1 * 12/2001 Jager ..... 384/107
6,450,781 B1 * 9/2002 Petrovich et al. ..... 417/350
6,455,964 B1 * 9/2002 Nims ..... 310/90
6,664,686 B2 * 12/2003 Ichiyama ..... 310/90.5
7,063,519 B2 * 6/2006 Agrawal et al. ..... 417/423.1
7,342,332 B2 * 3/2008 McAuliffe et al. ..... 310/58
7,394,175 B2 * 7/2008 McAuliffe et al. ..... 310/58
7,648,279 B2 * 1/2010 Struziak et al. ..... 384/103
7,648,280 B2 * 1/2010 Struziak et al. ..... 384/106
7,757,502 B2 * 7/2010 Merritt et al. ..... 62/172

(Continued)

*Primary Examiner* — Kang Hu
*Assistant Examiner* — Eric Gorman
(74) *Attorney, Agent, or Firm* — Carlson, Gaskey & Olds, PC

(57) ABSTRACT

An air bearing shaft has a first cylindrical portion with a relatively small outer diameter, and a ramped surface extending at an angle that is non-perpendicular and non-parallel to a central axis of a shaft body. The ramped surface leads into a second cylindrical portion of the shaft has a large outer diameter that is greater than the diameter of the first cylindrical portion. There are twelve air holes formed to extend into an interior of the second cylindrical portion. A bore diameter is defined to an inner periphery of the second cylindrical portion at the location of the air holes. A ratio of the bore diameter to a diameter of the air holes is between 6.30 and 6.54. In addition, a bearing assembly, a compressor, and a method of incorporating an air bearing shaft into a compressor are all disclosed and claimed.

9 Claims, 2 Drawing Sheets

(56) References Cited

U.S. PATENT DOCUMENTS

| | | | | |
|---|---|---|---|---|
| 8,517,665 | B2 * | 8/2013 | Lugo et al. | 415/107 |
| 2002/0180159 | A1 * | 12/2002 | Nakamura et al. | 277/500 |
| 2005/0210875 | A1 * | 9/2005 | Larue et al. | 60/602 |
| 2006/0057003 | A1 * | 3/2006 | Mitsuda et al. | 417/423.12 |
| 2006/0073030 | A1 * | 4/2006 | McAuliffe et al. | 417/366 |
| 2008/0080966 | A1 * | 4/2008 | Ueno et al. | 415/112 |
| 2008/0148588 | A1 * | 6/2008 | Yoshizumi et al. | 33/561 |
| 2008/0185928 | A1 * | 8/2008 | Buhler et al. | 310/90.5 |
| 2009/0257900 | A1 * | 10/2009 | Beers et al. | 418/55.2 |
| 2011/0229351 | A1 * | 9/2011 | Beers et al. | 417/372 |
| 2012/0064814 | A1 * | 3/2012 | Beers et al. | 454/71 |
| 2012/0064815 | A1 * | 3/2012 | Beers et al. | 454/71 |
| 2012/0152383 | A1 * | 6/2012 | Lugo et al. | 137/565.01 |
| 2013/0101435 | A1 * | 4/2013 | Colson et al. | 416/245 R |
| 2013/0109481 | A1 * | 5/2013 | Eccles et al. | 464/7 |

* cited by examiner

SHAFT FOR AIR BEARING AND MOTOR COOLING IN COMPRESSOR

BACKGROUND

This application relates to a shaft which is incorporated into an air bearing in a compressor.

Compressors are known and include a motor driven to rotate a shaft and drive a compressor rotor. Typically, bearings are incorporated into a housing to support the shaft for rotation. One known type of compressor bearing is an air bearing.

In one known air bearing, cooling air is brought into a bearing cooling inlet. That cooling air may pass between the shaft and various housing portions and journal bearings. The air typically passes between the journal bearings and an outer periphery of an air bearing shaft.

The air bearing shaft may be provided with holes to separate the air between the interior of the air bearing shaft, and along a path between the exterior of the air bearing shaft and the journal bearings. In the past, there has been insufficient cross-sectional area amongst the holes to direct sufficient air to the interior relative to the amount of air being passed along the exterior.

SUMMARY

An air bearing shaft has a first cylindrical portion with a relatively small outer diameter, and a ramped surface extending at an angle that is non-perpendicular and non-parallel to a central axis of a shaft body. The ramped surface leads into a second cylindrical portion of the shaft that has an outer diameter that is greater than the diameter of the first cylindrical portion. There are twelve air holes formed to extend into an interior of the second cylindrical portion. A bore diameter is defined to an inner periphery of the second cylindrical portion at the location of the air holes. A ratio of the bore diameter to a diameter of the air holes is between 6.30 and 6.54.

In addition, a bearing assembly, a compressor, and a method of incorporating an air bearing shaft into a compressor are all disclosed and claimed.

These and other features of the present invention can be best understood from the following specification and drawings, the following of which is a brief description.

DETAILED DESCRIPTION

Figures 1A, 1B:
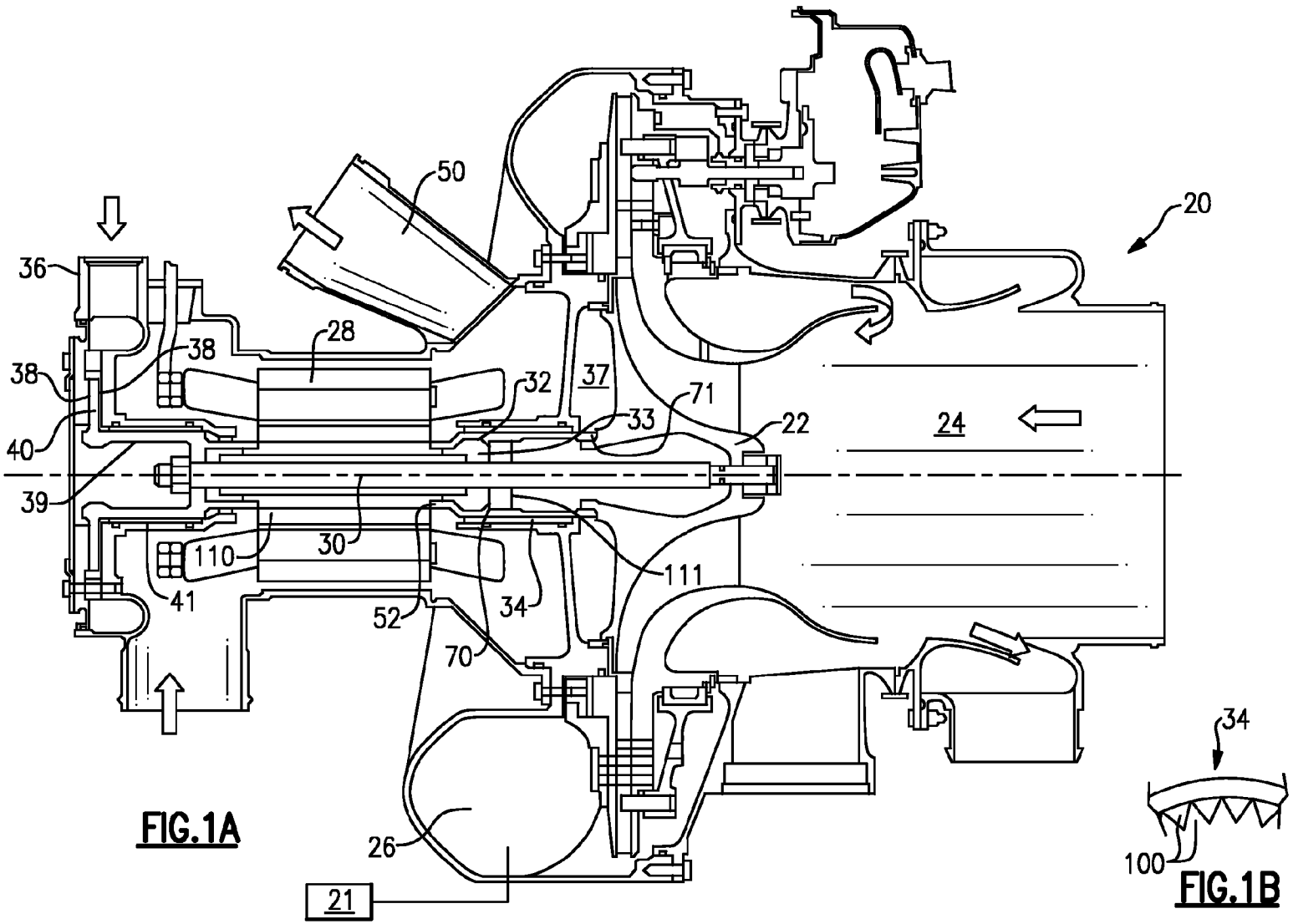
FIG. 1A is a cross-sectional view of a compressor utilizing the present invention.
FIG. 1B shows a feature of the compressor.

FIG. 1A shows a compressor 20 that may be incorporated into a cabin air supply system 21 for supplying air to the cabin of an aircraft. A rotor 22 receives air to be compressed from an inlet 24, and compresses the air to a compressor outlet 26. A motor 28 drives a driveshaft or tie-rod 30 to rotate the rotor 22.

An air bearing shaft 32 is positioned radially inward of journal bearings 34. Air passes into a cooling inlet 36, and between thrust bearing surfaces 38 and a thrust bearing disk 40 which is associated with a thrust shaft 39. The air passes along the thrust bearing surfaces 38, and between the outer periphery of the thrust shaft 39 and journal bearings 41. Air then passes further downstream, and across the bearings 34.

In addition, holes pass the air into the interior 33 of the air bearing shaft 32. The air passes along the outer periphery of the air bearing shaft 32, and the inner periphery of the bearings 34 to provide the air bearing. That air then passes to an area 37, and ultimately to the cooling air outlet 50. In addition, a portion of the air passes through the air holes 58 (see FIGS. 2 and 3) into the interior space 33.

FIG. 1B shows a structure of an example bearing 34 which has an outer surface and interior corrugations 100 which define flow passages both between the corrugations 100, and inwardly of the corrugations 100 and outwardly of the air bearing shaft 32.

Figure 2:
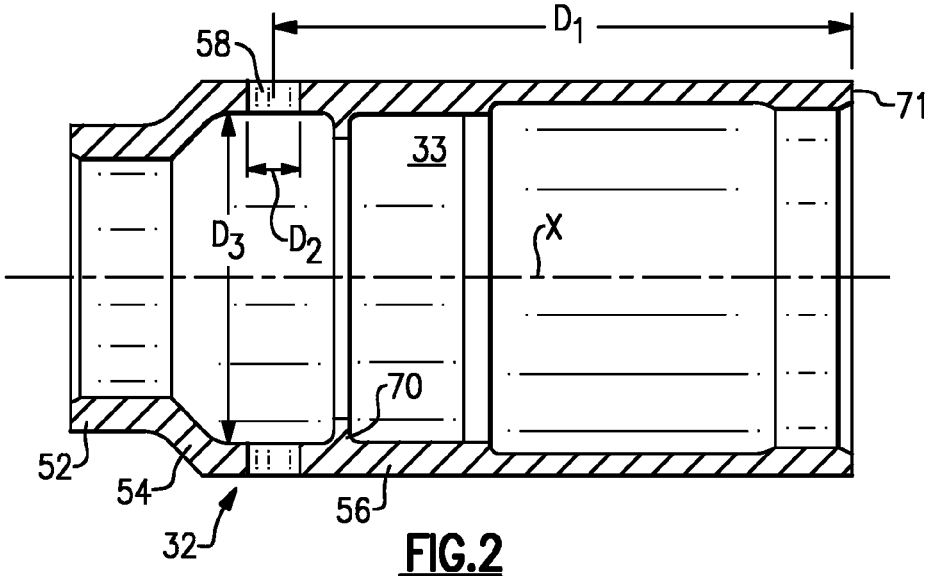
FIG. 2 is a cross-sectional view through an air bearing shaft.

FIG. 2 shows the body of air bearing shaft 32. As shown, a first cylindrical portion 52 will be positioned adjacent to the motor 28 when the air bearing shaft 32 is mounted within a compressor. A ramp portion 54 is ramped at an angle which is non-perpendicular and non-parallel to a central axis X of the air bearing shaft 32. The central axis X is also the rotational axis of the tie-rod 30. The ramped portion 54 leads into a second cylindrical portion 56. Second cylindrical portion 56 has a larger diameter than first cylindrical portion 52.

Holes 58 for delivering the air into the interior of the air bearing shaft 32, and space 33 are centered at an axial distance $D_1$ from end 71 of the shaft 32. An internal ledge 70 is positioned between end 71 and the holes 58.

The holes 58 have a diameter $D_2$. A diameter to the inner periphery of the air bearing shaft 32 at the location of the holes 58 is $D_3$.

In one embodiment, $D_1$ was 2.83" (7.18 cm). $D_2$ was 0.257" (0.653 cm), and $D_3$ was 1.650. In embodiments, a ratio of $D_1$ to $D_2$ was between 10.80 and 11.21, and a ratio of $D_3$ to $D_2$ is between 6.30 and 6.54.

Figure 3:
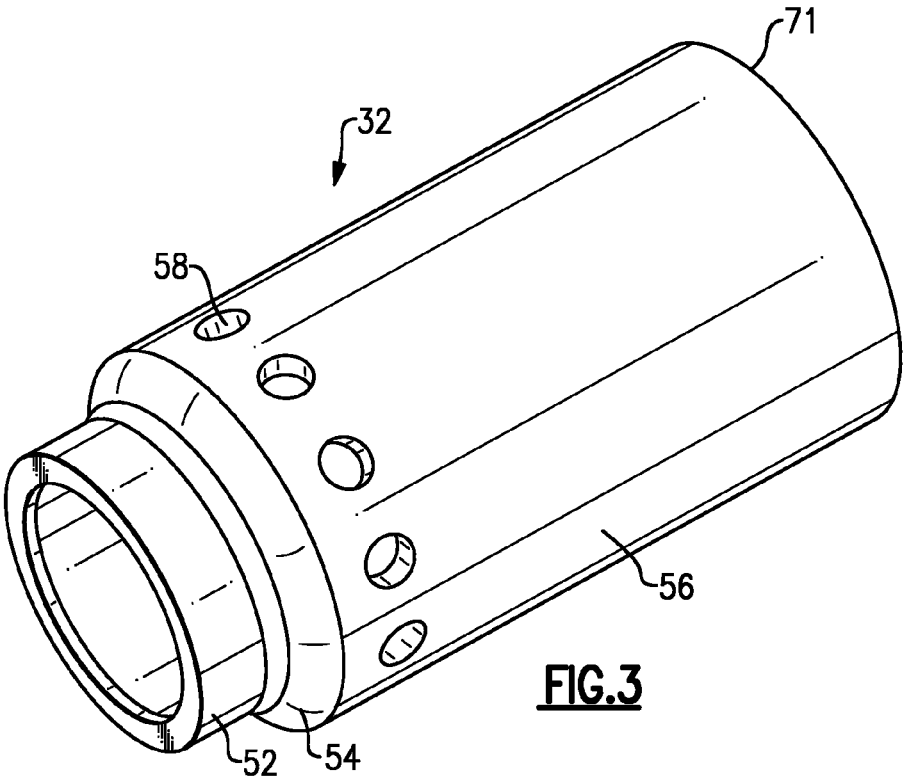
FIG. 3 is a perspective view of the FIG. 2 shaft.

As shown in FIG. 3, in this embodiment, there are a great number of holes 58. In particular, there are twelve equally spaced holes across the circumference of the air bearing shaft 32.

The provision of twelve holes ensures that there will be adequate air delivered into the area 33 relative to air passing between the outer periphery of the air bearing shaft 32, and the inner periphery of the bearings 34, and to area 37.

To assemble the compressor 20, the rotor 22, and a motor rotor 110 may each be placed in liquid nitrogen to shrink their size. Then, the thrust bearing shaft 39, and the air bearing shaft 32 may be placed on the motor rotor 110. The first cylindrical portion 52 of the air bearing shaft 32 sits on the motor rotor 110, as shown. Further, the forward end 71 of the air bearing shaft sit on the rotor 22. In addition, a tie-rod support 111 is force-fit into the interior of the air bearing shaft 32, and against the ledge 70. The tie-rod support 111 further receives an interference fit with the main shaft or tie-rod 30.

As the rotors 110 and 22 warm, they expand, and lock onto the air bearing shaft 32 and thrust bearing shaft 39. The tie-rod 30 is inserted through the rotor 22, air bearing shaft 32, rotor 110, and thrust bearing shaft 39, and the tie-rod is tightened with a nut to secure all of the assembled components together.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. An air bearing shaft comprising:

a shaft body having a first cylindrical portion with a relatively small outer diameter, and a ramped surface that extends at an angle that is non-perpendicular and non-parallel to a central axis of the shaft body, said ramped surface leading into a second cylindrical portion with a diameter greater than the diameter of said first cylindrical portion;

twelve air holes formed in said shaft body, and extending into an interior of said second cylindrical portion, a bore diameter being defined to an inner periphery of said second cylindrical portion at said air holes, and a ratio of said bore diameter to a diameter of said air holes is between 6.30 and 6.54;

a distance defined from an axial end of said second cylindrical portion remote from said ramped portion, and a ratio of said distance to said diameter of said air holes is between 10.80 and 11.21; and said twelve holes being equally spaced about a circumference of said second cylindrical portion.

2. An air bearing assembly comprising:

a journal bearing having air flow passages;

an air bearing shaft having a shaft body with a first cylindrical portion having a relatively small outer diameter, and a ramped surface that extends at an angle that is non-perpendicular and non-parallel to a central axis of the shaft body, said ramped surface leading into a second cylindrical portion that has a diameter that is greater than the diameter of said first cylindrical portion, and twelve air holes formed in said shaft body, and extending into an interior of said second cylindrical portion, a bore diameter being defined to an inner periphery of said second cylindrical portion at said air holes, and a ratio of said bore diameter to a diameter of said air holes is between 6.30 and 6.54; and a distance defined from an axial end of said second cylindrical portion remote from said ramped portion, and a ratio of said distance to said diameter of said air holes is between 10.80 and 11.21.

3. The air bearing assembly as set forth in claim 2, wherein said twelve holes are equally spaced about a circumference of said second cylindrical portion.

4. The air bearing assembly as set forth in claim 2, wherein said journal bearing has a plurality of corrugations to form air passages.

5. An air compressor for supplying air to an aircraft cabin comprising:

a motor driving a main shaft, said main shaft driving a compressor rotor;

an air bearing system, including an air supply for supplying a source of air into a housing for housing said motor, said main shaft and said compressor rotor, an air bearing positioned to be radially outward of an air bearing shaft, and a central axis defined by said main shaft, said air bearing being positioned axially between said motor and said rotor;

the air bearing shaft having a shaft body with a first cylindrical portion having a relatively small outer diameter, and a ramped surface that extends at an angle that is non-perpendicular and non-parallel to a central axis of the shaft body, said ramped surface leading into a second cylindrical portion that has a diameter greater than the diameter of said first cylindrical portion, and twelve air holes formed in said shaft body, and extending into an interior of said second cylindrical portion, a bore diameter being defined to an inner periphery of said second cylindrical portion at said air holes, and a ratio of said bore diameter to a diameter of said air holes is between 6.30 and 6.54;

the first cylindrical portion secured on an outer periphery of a rotor for said motor, and an end of said second cylindrical portion remote from said ramped portion being secured on a surface of said compressor rotor, with said main shaft being a tie-rod extending through said rotor, said air bearing shaft, and said motor rotor, and securing the components together to rotate as one; and wherein a distance is defined from an axial end of said second cylindrical portion remote from said ramped portion, and a ratio of said distance to said diameter of said air holes is between 10.80 and 11.21.

6. The air compressor as set forth in claim 5, wherein said twelve holes are equally spaced about a circumference of said second cylindrical portion.

7. The air compressor as set forth in claim 5, wherein said air bearing includes a plurality of corrugations to define air passages.

8. The air compressor as set forth in claim 5, wherein an airflow path includes air passing along thrust bearing surfaces and between an outer periphery of a thrust bearing shaft, along thrust bearing surfaces, and between an outer periphery of the thrust bearing shaft, and journal bearings, and then a portion of the air flowing through said holes into the interior of said air bearing shaft.

9. A method of installing an air bearing shaft in a compressor comprising the steps of:

(a) providing an air bearing shaft having a shaft body including a first cylindrical portion with a relatively small outer diameter, and a ramped surface that extends at an angle that is non-perpendicular and non-parallel to a central axis of the shaft body, said ramped surface leading into a second cylindrical portion that has a diameter greater than the diameter of said first cylindrical portion, twelve air holes formed in said shaft body, and extending into an interior of said second cylindrical portion, a bore diameter being defined to an inner periphery of said second cylindrical portion at said air holes, and a ratio of said bore diameter to a diameter of said air holes is between 6.30 and 6.54, a distance defined from an axial end of said second cylindrical portion remote from said ramped portion, and a ratio of said distance to said diameter of said air holes is between 10.80 and 11.21, said twelve holes being equally spaced about a circumference of said second cylindrical portion;

(b) securing said air bearing shaft to a motor rotor, and to a compressor rotor;

(c) securing said compressor rotor, said air bearing shaft, and said motor rotor together with a tie-rod which is tightened to secure the components to rotate as one; and (d) positioning said air bearing shaft disk between opposed housing surfaces, with said opposed housing surfaces defining thrust bearing surfaces.

* * * * *